US011814788B2

(12) United States Patent
Eastman et al.

(10) Patent No.: US 11,814,788 B2
(45) Date of Patent: Nov. 14, 2023

(54) ELEVATOR LOAD BEARING MEMBER HAVING A FABRIC STRUCTURE

(71) Applicant: OTIS ELEVATOR COMPANY, Farmington, CT (US)

(72) Inventors: Scott Alan Eastman, Glastonbury, CT (US); Michael Paul Humbert, Wethersfield, CT (US); Daniel A. Mosher, Glastonbury, CT (US); Wenping Zhao, Glastonbury, CT (US); Danielle L. Grolman, East Hartford, CT (US); Brad Guilani, Woodstock Valley, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 1198 days.

(21) Appl. No.: 16/377,662

(22) Filed: Apr. 8, 2019

(65) Prior Publication Data

US 2020/0318286 A1 Oct. 8, 2020

(51) Int. Cl.
*D07B 1/00* (2006.01)
*D07B 5/00* (2006.01)
(Continued)

(52) U.S. Cl.
CPC ..... *D07B 1/005* (2013.01); *B66B 7/062* (2013.01); *D07B 5/006* (2015.07); *D07B 5/045* (2021.01); *D07B 2201/1012* (2013.01); *D07B 2201/2009* (2013.01); *D07B 2201/2012* (2013.01); *D07B 2205/20* (2013.01); *D07B 2501/2007* (2013.01)

(58) Field of Classification Search
None
See application file for complete search history.

(56) References Cited

U.S. PATENT DOCUMENTS 1,475,250 A 11/1923 Sundh
2,332,393 A 10/1943 Neville
(Continued)

FOREIGN PATENT DOCUMENTS

CN 204000410 U 12/2014
DE 10100484 A1 7/2002
(Continued)

OTHER PUBLICATIONS

Extended European Search Report for Application No. EP 19 21 9667 dated Jul. 31, 2020.

*Primary Examiner* — Arti Singh-Pandey
(74) *Attorney, Agent, or Firm* — Carlson, Gaskey & Olds, P.C.

(57) ABSTRACT

An illustrative example assembly for making an elevator load bearing member includes a fabric having a plurality of fibers arranged with some of the fibers transverse to others of the fibers. A plurality of cords are configured to support a load associated with an elevator car. The cords are included in the fabric and have respective coatings. The coatings include a first coating material and a second coating material, or include different coating thicknesses such that some of the coatings have a different coating thickness than others of the coatings, or the coatings include the first coating material and the second coating material and some of the coatings have a different coating thickness than others of the coatings.

20 Claims, 3 Drawing Sheets

(51) Int. Cl.
*B66B 7/06* (2006.01)
*D07B 5/04* (2006.01)

(56) References Cited

U.S. PATENT DOCUMENTS

| | | | | |
|---|---|---|---|---|
| 3,148,710 | A | 9/1964 | Rieger et al. | |
| 3,885,603 | A | 5/1975 | Slaughter | |
| 4,227,041 | A | 10/1980 | Den et al. | |
| 4,773,896 | A | 9/1988 | Bouteiller et al. | |
| 4,945,952 | A | 8/1990 | Vohringer | |
| 5,609,242 | A | 3/1997 | Hutchins et al. | |
| 6,371,448 | B1 | 4/2002 | De Angelis | |
| 6,386,324 | B1 | 5/2002 | Baranda et al. | |
| 6,390,242 | B1 | 5/2002 | Baranda et al. | |
| 6,419,208 | B1 | 7/2002 | Baranda et al. | |
| 6,672,046 | B1 | 1/2004 | Prewo et al. | |
| 6,739,433 | B1 | 5/2004 | Baranda et al. | |
| 6,742,769 | B2 | 6/2004 | Baranda et al. | |
| 6,983,826 | B2 * | 1/2006 | Wake | B66B 11/043 187/250 |
| 7,326,139 | B2 | 2/2008 | Eichhorn et al. | |
| 8,556,040 | B2 | 10/2013 | Fargo et al. | |
| 2002/0108814 | A1 | 8/2002 | Pitts et al. | |
| 2004/0206579 | A1 | 10/2004 | Baranda et al. | |
| 2004/0231312 | A1 | 11/2004 | Honda | |
| 2007/0235595 | A1 | 10/2007 | Braekevelt et al. | |
| 2009/0107776 | A1 | 4/2009 | Baranda et al. | |
| 2010/0133046 | A1 | 6/2010 | Allwardt et al. | |
| 2013/0167967 | A1 * | 7/2013 | Wesson | D03D 1/0094 139/420 R |
| 2015/0017436 | A1 * | 1/2015 | Krishnan | C23C 22/03 428/394 |
| 2018/0162695 | A1 | 6/2018 | Eastman et al. | |
| 2019/0084803 | A1 * | 3/2019 | Eastman | D07B 1/162 |

FOREIGN PATENT DOCUMENTS

| | | | |
|---|---|---|---|
| EP | 0228725 | A1 | 7/1987 |
| EP | 1396458 | A2 | 3/2004 |
| EP | 1561719 | A1 | 8/2005 |
| EP | 1777189 | A1 | 4/2007 |
| GB | 2048773 | A | 12/1980 |
| JP | 2004155589 | A | 6/2004 |
| KR | 20180121595 | A | 11/2018 |
| WO | 01/14630 | A1 | 3/2001 |
| WO | 2005/007988 | A2 | 1/2005 |
| WO | 2009/041970 | A1 | 4/2009 |
| WO | 2017/155943 | A1 | 9/2017 |

* cited by examiner

ELEVATOR LOAD BEARING MEMBER HAVING A FABRIC STRUCTURE

BACKGROUND

A variety of elevator systems are known. Some elevator systems use a hydraulic arrangement for moving the elevator car. Others are traction-based and include roping that suspends the elevator car and a counterweight. A machine causes movement of a traction sheave that, in turn, causes movement of the roping for moving the elevator car as desired.

For many years, roping in elevator systems included round steel ropes. More recently, flat belt technologies were developed that provided advantages over traditional, round steel rope arrangements. Even with the advancement, those skilled in the art have been striving to improve elevator load bearing member technology.

SUMMARY

An illustrative example assembly for making an elevator load bearing member includes a fabric having a plurality of fibers arranged with some of the fibers transverse to others of the fibers. A plurality of cords are configured to support a load associated with an elevator car. The cords are included in the fabric and have respective coatings. The coatings include a first coating material and a second coating material, or include different coating thicknesses such that some of the coatings have a different coating thickness than others of the coatings, or the coatings include the first coating material and the second coating material and some of the coatings have a different coating thickness than others of the coatings.

In an example embodiment having one or more features of the assembly of the previous paragraph, the coatings comprise the first coating material and the second coating material, the first coating material has a first melting temperature, the second coating material has a second melting temperature, and the first melting temperature is higher than the second melting temperature.

In an example embodiment having one or more features of the assembly of any of the previous paragraphs, the first coating material is received against the cords and the second coating material is received against the first coating material.

In an example embodiment having one or more features of the assembly of any of the previous paragraphs, the fibers of the fabric comprise a material that has a third melting temperature that is higher than the second melting temperature.

In an example embodiment having one or more features of the assembly of any of the previous paragraphs, the third melting temperature is higher than the first melting temperature.

In an example embodiment having one or more features of the assembly of any of the previous paragraphs, the coatings comprise the first coating material and the second coating material, the first coating material comprises a first thermoplastic material, the second coating material comprises a second thermoplastic material, and the first thermoplastic material is different than the second thermoplastic material.

In an example embodiment having one or more features of the assembly of any of the previous paragraphs, the first coating material comprises at least one of nylon, polyurethane, polyethylene, polypropylene, polyester, thermoplastic polyolefin (TPO), thermoplastic elastomer (TPE), or polyvinylchloride (PVC); and the second coating material comprises at least one other of nylon, polyurethane, polyethylene, polypropylene, polyester, thermoplastic polyolefin (TPO), thermoplastic elastomer (TPE), or polyvinylchloride (PVC).

In an example embodiment having one or more features of the assembly of any of the previous paragraphs, the fibers are interlaced together, the cords are interlaced into the fabric, the fabric has a length, a thickness and a width, the length of the fabric is longer than the thickness and the width, the cords are generally parallel to each other along the length, and the cords are in selected locations along the width of the fabric.

In an example embodiment having one or more features of the assembly of any of the previous paragraphs, the coating thickness is less than the thickness of the fabric.

In an example embodiment having one or more features of the assembly of any of the previous paragraphs, some of the coatings have a different coating thickness than others of the coatings, some of the coatings are closer to edges of the width of the fabric than the others of the coatings, and the coating thickness of some of the coatings is larger than the coating thickness of the others of the coatings.

In an example embodiment having one or more features of the assembly of any of the previous paragraphs, some of the coatings have a different coating thickness than others of the coatings, the coating thickness of some of the coatings is a first coating thickness, the coating thickness of the others of the coatings is a second coating thickness, and the cords are arranged with at least one of the coatings having the second coating thickness between at least two of the coatings having the first coating thickness.

In an example embodiment having one or more features of the assembly of any of the previous paragraphs, the fabric has a length and a width, the length is greater than the width, the cords are generally parallel to the length, the cords are spaced apart along the width, and the coatings having the first coating thickness are closer to outside edges of the fabric than the coatings having the second coating thickness.

In an example embodiment having one or more features of the assembly of any of the previous paragraphs, a plurality of the coatings having the second coating thickness are adjacent to each other and situated between the coatings having the first coating thickness.

In an example embodiment having one or more features of the assembly of any of the previous paragraphs, the cords comprise at least one of a metal or a polymer.

An illustrative example method of making a load bearing member for an elevator system includes assembling a fabric including a plurality of fibers and a plurality of cords. Some of the fibers are transverse to others of the fibers, the cords are generally parallel to each other, the cords are transverse to the others of the fibers, and the cords have respective coatings. The coatings comprise a first coating material and a second coating material, some of the coatings have a different coating thickness than others of the coatings, or the coatings comprise the first coating material and the second coating material and some of the coatings have a different coating thickness than others of the coatings. The method includes at least partially melting the coatings to thereby impregnate the fibers with coating material.

In an example embodiment having one or more features of the method of the previous paragraph, the cords have respective coatings that comprise the first coating material and the second coating material, the first coating material has a first melting temperature, the second coating material has a second melting temperature, the first melting temperature is higher than the second melting temperature, and at least partially melting the coatings comprises at least partially melting only the second coating material.

In an example embodiment having one or more features of the method of any of the previous paragraphs, the first coating material is received against the cords and the second coating material is received against the first coating material.

In an example embodiment having one or more features of the method of any of the previous paragraphs, assembling the fabric comprises interlacing the fibers and the cords.

In an example embodiment having one or more features of the method of any of the previous paragraphs, some of the coatings have a different coating thickness than others of the coatings, the coating thickness of the some of the coatings is a first coating thickness, the coating thickness of the others of the coatings is a second coating thickness, and assembling the fabric comprises arranging the cords with at least one of the coatings having the second coating thickness between at least two of the coatings having the first coating thickness.

In an example embodiment having one or more features of the method of any of the previous paragraphs, assembling the fabric comprises arranging a plurality of the coatings having the second coating thickness adjacent to each other and situating the plurality of the coatings having the second coating thickness between the coatings having the first coating thickness.

The various features and advantages of at least one disclosed example embodiment will become apparent to those skilled in the art from the following detailed description. The drawings that accompany the detailed description can be briefly described as follows.

DETAILED DESCRIPTION

Figure 1:
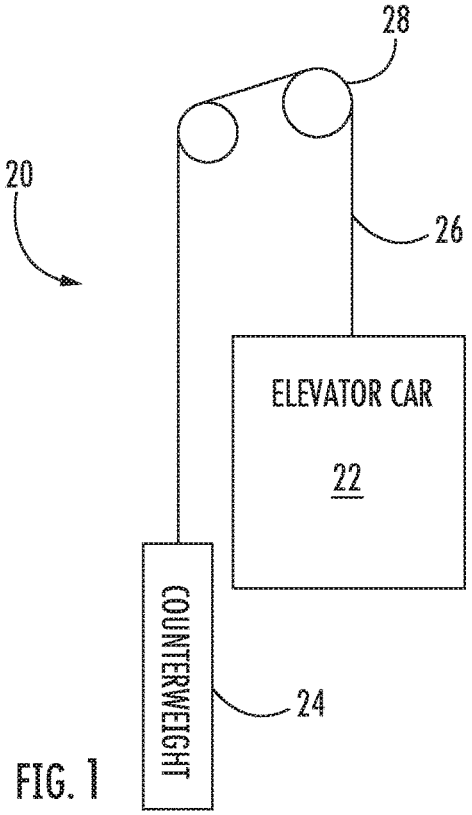
FIG. 1 schematically illustrates selected portions of an elevator system including a load bearing member designed according to an embodiment of this invention.

FIG. 1 schematically shows selected portions of an elevator system 20. An elevator car 22 and counterweight 24 are suspended by a load bearing member 26. A traction sheave 28 associated with a machine (not specifically illustrated) selectively controls movement of the load bearing member 26 to control the movement or position of the elevator car 22. For illustration purposes, a single load bearing member 26 is represented in FIG. 1. Multiple load bearing members would be included in many embodiments.

Figure 2:
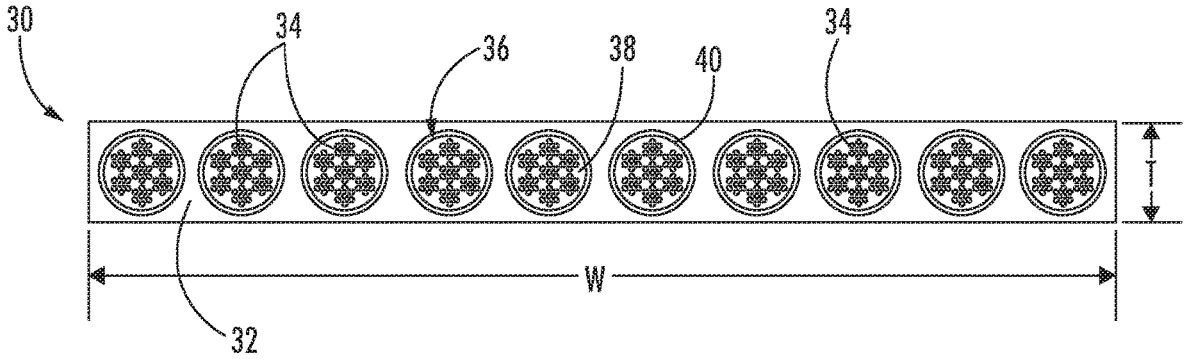
FIG. 2 is an end view schematically illustrating features of an example embodiment of an assembly for making an elevator load bearing member.

FIG. 2 schematically illustrates an assembly 30 for making the load bearing member 26. In this example embodiment, the load bearing member 26 is a flat belt having a generally rectangular cross-section. The assembly 30 includes a fabric 32 made up of a plurality of fibers that are arranged transverse to each other. In some examples, the fabric 32 is woven while in others it is knitted or braided. Interlaced fibers may be arranged in a variety of ways to establish the fabric 32.

A plurality of cords 34 are included in the fabric 32. The cords 34 are interlaced with the fibers of the fabric 32. The cords 34 are configured to support the loads associated with the elevator car 22. In some examples, the cords 34 comprise a plurality of metal wires or strands. In some embodiments the cords comprise a polymer, such as carbon fibers or poly-para-phenylene terephthalamide.

The assembly 30 has a width W and thickness T visible in the illustration. A length of the assembly 30 extends into the page. The cords 34 are arranged parallel to each other and extend along the length of the assembly 30. The cords 34 are spaced apart from each other along the width W. In the illustrated example, the cords have the same dimensions and are equally spaced apart across the width W of the assembly 30.

Each of the cords 34 has a respective coating 36. In this example the coatings 36 each include a first coating material 38 received against the cords 34. A second coating material 40 is received over the first coating material 38.

The coating materials 38 and 40 have different compositions. In this example, the first coating material 38 has a first melting temperature and the second coating material 40 has a second melting temperature. The first melting temperature is higher than the second melting temperature. This allows for the second coating material 40 to be at least partially melted without melting the first coating material 38. The fabric 32 has a melting temperature that is higher than the second melting temperature. In some embodiments, the fabric melting temperature is higher than the first melting temperature.

In some embodiments, the first coating material comprises a thermoplastic and the second coating material comprises a second thermoplastic. Example materials for either of the coating materials include nylon, polyurethane, polyethylene, polypropylene, polyester, thermoplastic polyolefin (TPO), thermoplastic elastomer (TPE), or polyvinylchloride (PVC).

Figure 3:
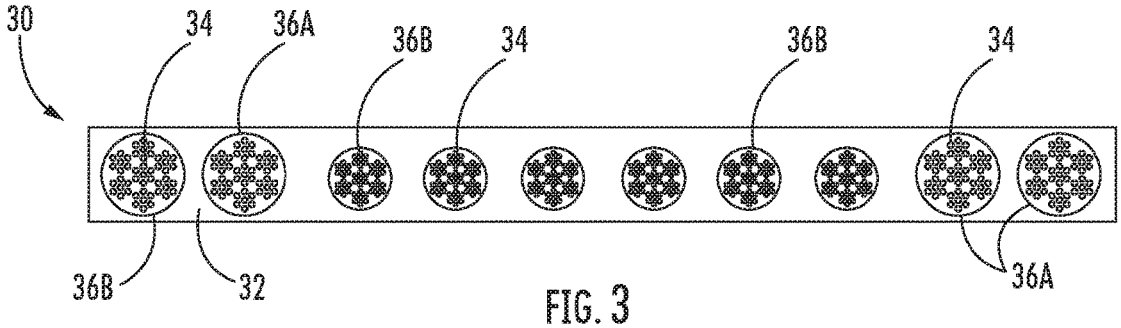
FIG. 3 is an end view schematically illustrating another example embodiment.

FIG. 3 schematically illustrates another embodiment of an assembly 30 for making an elevator load bearing member. In this example, the cords 34 are interlaced with the fibers of the fabric 32 and arranged in a similar pattern as those in the example of FIG. 2. In this embodiment, some of the coatings 36 have a different thickness compared to other coatings. The coatings 36A on the cords 34 that are closest to the outside edges of the assembly 30 in the width direction are thicker than other coatings 36B on others of the cords 34 that are situated more centrally within the assembly 30. The coatings 36A have a first coating thickness and the coatings 36B have a second, smaller coating thickness. In this example, a majority of the cords 34 have a coating 36B with a smaller coating thickness compared to that of the coatings 36A. At least one coating 36B is situated between two of the coatings 36A.

In some example embodiments, the thickness of the coatings 36 is in a range from 0.01 to 2.0 mm. In some embodiments, the preferred range of coating thickness is between 0.1 and 0.5 mm. The coating thickness is smaller than the thickness T of the fabric 32.

One aspect of having coatings 36A on the cords 34 that are closer to the outside, lateral edges of the assembly 30 is that the distribution of coating material in the load bearing member made from the assembly 30 will have desired characteristics for maintaining desired performance during elevator system operation. For example, an adequate amount of coating material will be within the fabric 32 near all of the cords 34 to provide a protective coating throughout the service life of the load bearing member.

Figure 4:
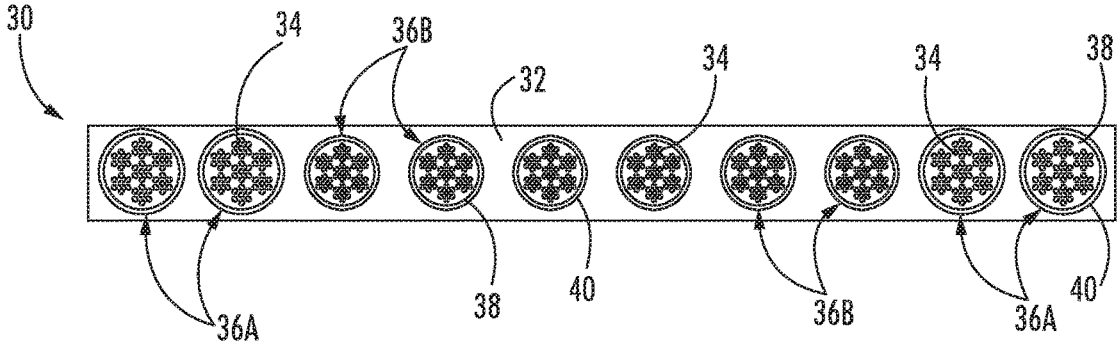
FIG. 4 is an end view schematically illustrating another example embodiment.

FIG. 4 schematically illustrates another example assembly 30 for making an elevator load bearing member. In this example, the features of FIGS. 2 and 3 are combined. The coatings 36 include a first coating material 38 and a second coating material 40. Additionally, some of the coatings 36A have a first coating thickness while others of the coatings 36B have a second coating thickness. As can be appreciated from the illustration, the first coating thickness of the coatings 36A is larger than the second coating thickness of the coatings 36B. The cords 34 having coatings with the larger coating thickness are situated closer to the outside lateral edges of the assembly 30.

The arrangements shown in FIGS. 2-4 are useful for making load bearing members that have a flat belt configuration. Other embodiments have different shapes because the finished product load bearing member has a configuration other than a flat, generally rectangular belt. Given this description, those skilled in the art will realize how to incorporate the features of the illustrated example embodiments into assemblies for making load bearing members having shapes that meet their particular needs.

Figure 5:
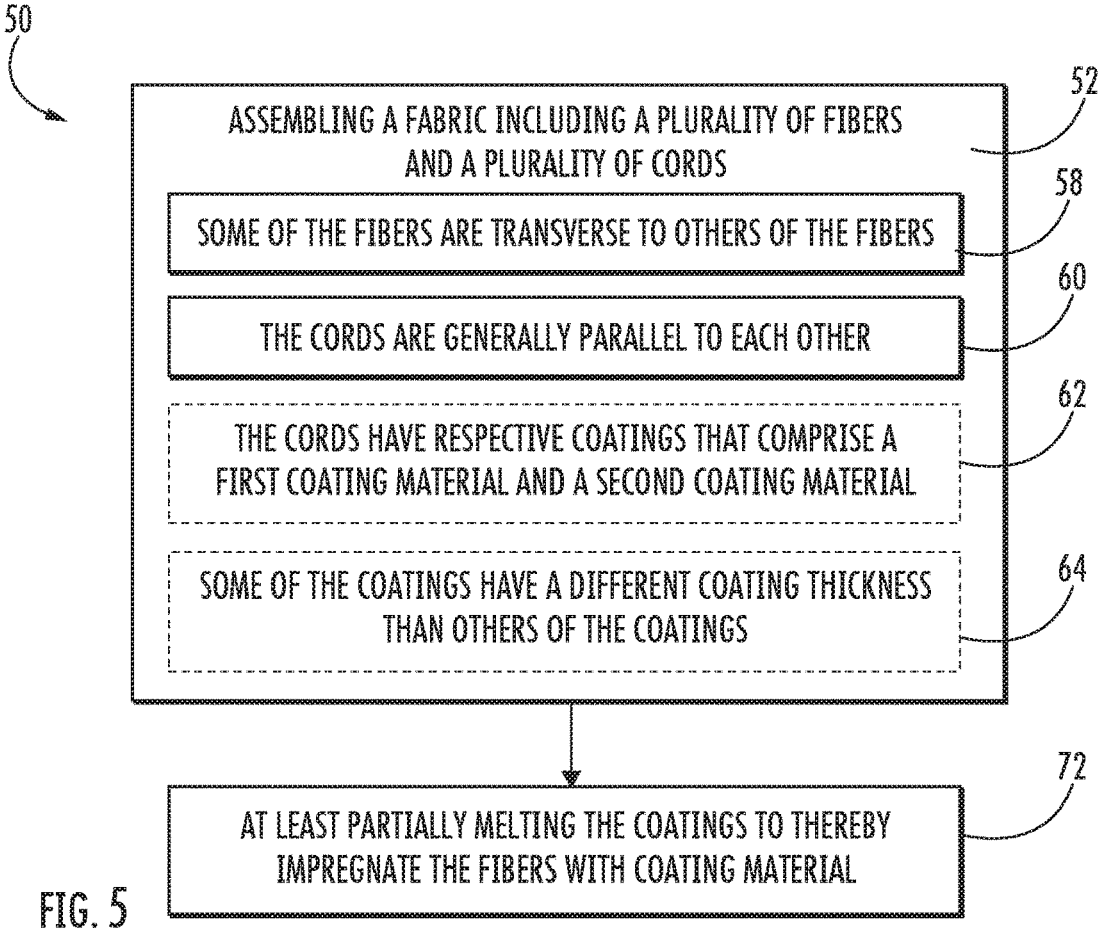
FIG. 5 is a flowchart diagram summarizing an example method of making an elevator load bearing member.
Figure 6:
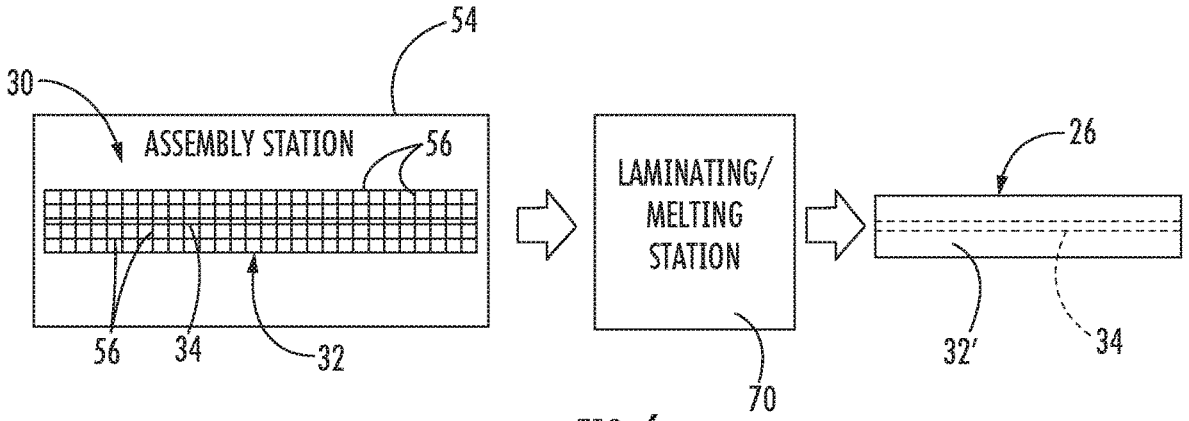
FIG. 6 schematically illustrates a technique of making an elevator load bearing member.

FIGS. 5 and 6 illustrate an example technique of making the load bearing member 26 from an assembly, such as the example assemblies 30. The flowchart diagram 50 in FIG. 5 begins at 52, which includes assembling a fabric including a plurality of fibers and a plurality of cords. FIG. 6 schematically illustrates an assembly station 54 in which the cords 34 are interlaced with fibers 56 of the fabric 32.

As represented at 58 in FIG. 5, some of the fibers 56 are transverse to others of the fibers. As indicated at 60, the cords 34 are generally parallel to each other in the assembly 30. The features represented at 62 and 64 are shown in broken line boxes because they are optional in some embodiments. At 62, the cords have respective coatings that comprise a first coating material and a second coating material. This feature may be included in an embodiment like that shown in FIG. 2. At 64, some of the coatings have a different coating thickness than others of the coatings. This feature may be included an embodiment as illustrated in FIG. 3. The features at 62 and 64 combined are included in other embodiments, such as that shown in FIG. 4.

In FIG. 6, the assembly 30 is fed into a laminating or melting station 70. As indicated at 72 in FIG. 5, the coatings 36 on the cords 34 are at least partially melted to thereby impregnate the fibers 56 of the fabric 32 with the coating material. The resulting load bearing member 26 is schematically shown in FIG. 6 with the cords 34 within the fabric 32' that has been impregnated with at least some of the coating material. One feature of the load bearing member 26 having the fabric impregnated with the coating material is that loads encountered by the load bearing member 26 are more distributed throughout the structure. Another feature is that the exterior characteristics of the fabric are better-suited to establish a desired traction in the elevator system 20.

Figure 7:
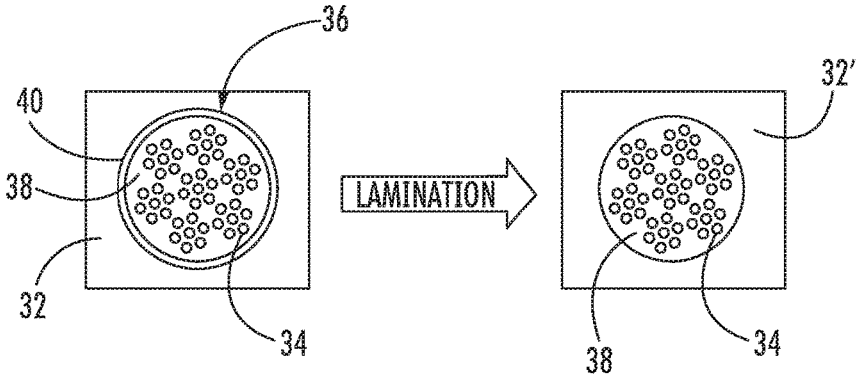
FIG. 7 schematically illustrates selected features of an example process for making an elevator load bearing member using an assembly like that shown in FIG. 2.

The left side of FIG. 7 schematically illustrates an individual cord 34 within the fabric 32 prior to any of the coating 36 being melted. As shown on the right side of FIG. 7, the second coating material 40 has been melted and disbursed through the fabric 32 to establish the impregnated fabric material 32'. The first coating material 38 has not melted but remains surrounding the cord 34. One feature of embodiments having two coating materials with different melting temperatures is that it allows for simplification of the laminating or melting process with less tolerance control requirements over the heat used during that process. Since the first coating material 38 will not melt, there is no concern over any of the cords 34 having inadequate protection after the melting step.

Maintaining a coating material 38 on the cords 34 in this manner can improve the wear characteristics and service life of the load bearing member 26 because the first coating material 38 may be chosen to provide a desired stiffness and fiber adhesion across the width of the load bearing member 26. Such an embodiment also provides the ability to protect the cords 34 with relatively harder materials than the fabric while, at the same time, providing a belt structure having a desired flexibility to be able to wrap around sheaves in an elevator system that may be arranged in a variety of patterns or configurations. A first coating material 38 that does not melt also protects the fabric from damage that otherwise may occur because of contact with the steel cords.

Figure 8:
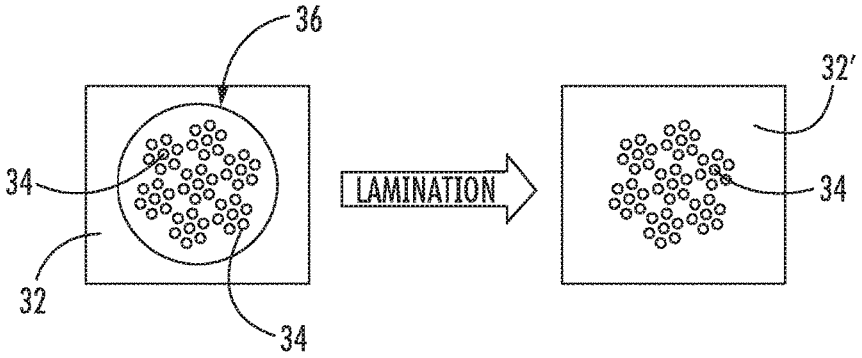
FIG. 8 schematically illustrates selected features of a process for making an elevator load bearing member using an assembly like that shown in FIG. 3.

FIG. 8 schematically illustrates an individual cord 34 with a coating 36 comprising a single material on the left hand side prior to lamination. After the coating material 36 is at least partially melted during the laminating process, the result is shown on the right side with the fabric 32' being impregnated with the coating material 36. When different coating thicknesses are used in such an embodiment, the amount of coating material impregnated into the fabric may vary across the width of a belt. This allows for providing more coating material in some locations where it may be needed more. For example, the edges of a belt may experience more wear over time and increasing the amount of coating material impregnated into the fabric 32' in those locations provides extended service life. Additionally, providing thicker coatings near the lateral edges of an assembly 30 results in a belt construction that may track better when installed in an elevator system.

The illustrated, disclosed example embodiments allow for customizing and enhancing selected features of a load bearing member 26, such as a flat belt, to achieve better performance, longer service life or both. The features of the different embodiments may be combined in other ways not specifically illustrated or mentioned above. In other words, additional embodiments may be realized by combining features of the example embodiments discussed above.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. An assembly for making an elevator load bearing member comprising:

a fabric having a plurality of fibers arranged with some of the fibers transverse to others of the fibers; and a plurality of cords configured to support a load associated with an elevator car, the plurality of cords being included in the fabric, the plurality of cords having respective coatings, and wherein some of the coatings have a different coating thickness than others of the coatings, and some of the coatings are closer to edges of the width of the fabric than others of the coatings, and the coating thickness of the some of the coatings is larger than the coating thickness of the others of the coatings.

2. The assembly of claim 1, wherein the coatings comprise a first coating material and a second coating material;

the first coating material has a first melting temperature;

the second coating material has a second melting temperature; and the first melting temperature is higher than the second melting temperature.

3. The assembly of claim 2, wherein the first coating material is received against the cords and the second coating material is received against the first coating material.

4. The assembly of claim 2, wherein the fibers of the fabric comprise a material that has a third melting temperature that is higher than the second melting temperature.

5. The assembly of claim 4, wherein the third melting temperature is higher than the first melting temperature.

6. The assembly of claim 1, wherein the coatings comprise a first coating material and a second coating material;

the first coating material comprises a first thermoplastic material;

the second coating material comprises a second thermoplastic material; and the first thermoplastic material is different than the second thermoplastic material.

7. The assembly of claim 6, wherein the first coating material comprises at least one of nylon, polyurethane, polyethylene, polypropylene, polyester, thermoplastic polyolefin (TPO), thermoplastic elastomer (TPE), or polyvinylchloride (PVC); and the second coating material comprises at least one other of nylon, polyurethane, polyethylene, polypropylene, polyester, thermoplastic polyolefin (TPO), thermoplastic elastomer (TPE), or polyvinylchloride (PVC).

8. The assembly of claim 1, wherein the fibers are interlaced together;

the cords are interlaced into the fabric;

the fabric has a length, a thickness and a width;

the length of the fabric is longer than the thickness and the width;

the cords are generally parallel to each other along the length; and the cords are in selected locations along the width of the fabric.

9. The assembly of claim 8, wherein the coating thickness is less than the thickness of the fabric.

10. The assembly of claim 1, wherein the coating thickness of the some of the coatings is a first coating thickness;

the coating thickness of others of the coatings is a second coating thickness; and the cords are arranged with at least one of the coatings having the second coating thickness between at least two of the coatings having the first coating thickness.

11. The assembly of claim 10, wherein the fabric has a length and a width;

the length is greater than the width;

the cords are generally parallel to the length; and the cords are spaced apart along the width.

12. The assembly of claim 11, wherein a plurality of the coatings having the second coating thickness are adjacent each other and situated between the coatings having the first coating thickness.

13. The assembly of claim 1, wherein the cords comprise at least one of a metal or a polymer.

14. An assembly for making an elevator load bearing member comprising:

a fabric having a plurality of fibers arranged with some of the fibers transverse to others of the fibers; and a plurality of cords configured to support a load associated with an elevator car, the plurality of cords being included in the fabric, the plurality of cords having respective coatings, wherein the coatings comprise a first coating material and a second coating material, and some of the coatings have a different coating thickness than others of the coatings.

15. The assembly of claim 14, wherein the first coating material has a first melting temperature;

the second coating material has a second melting temperature; and the first melting temperature is higher than the second melting temperature.

16. The assembly of claim 15, wherein the first coating material is received against the cords and the second coating material is received against the first coating material.

17. The assembly of claim 15, wherein the fibers of the fabric comprise a material that has a third melting temperature that is higher than the second melting temperature.

18. The assembly of claim 17, wherein the third melting temperature is higher than the first melting temperature.

19. The assembly of claim 14, wherein the first coating material comprises a first thermoplastic material;

the second coating material comprises a second thermoplastic material; and the first thermoplastic material is different than the second thermoplastic material.

20. The assembly of claim 19, wherein the first coating material comprises at least one of nylon, polyurethane, polyethylene, polypropylene, polyester, thermoplastic polyolefin (TPO), thermoplastic elastomer (TPE), or polyvinylchloride (PVC); and the second coating material comprises at least one other of nylon, polyurethane, polyethylene, polypropylene, polyester, thermoplastic polyolefin (TPO), thermoplastic elastomer (TPE), or polyvinylchloride (PVC).

* * * * *